US005452888A

United States Patent [19]

Glenn

[11] Patent Number: 5,452,888

[45] Date of Patent: Sep. 26, 1995

[54] PRACTICE TETHERED BASEBALL

[76] Inventor: Cecil R. Glenn, 230 Medford Pl., Jacksonville, Fla. 32225

[21] Appl. No.: 345,575

[22] Filed: Nov. 28, 1994

[51] Int. Cl.[6] ..... A63B 69/40

[52] U.S. Cl. ..... 273/26 E; 273/58 C; 273/185 C

[58] Field of Search ..... 273/26 E, 26 EA, 273/29 A, 58 C, 185 C, 184 B, 196, 197 R, 197 A, 200 R, 200 B, 185 D

[56] References Cited

U.S. PATENT DOCUMENTS

| | | | |
|---|---|---|---|
| 1,446,641 | 2/1923 | Craig | 273/200 |
| 1,597,307 | 8/1926 | Bettini | 273/185 C |
| 2,929,632 | 3/1960 | Moffatt | 273/185 C |
| 3,007,905 | 6/1961 | Ament | 273/26 E |
| 3,220,729 | 11/1965 | Whittington | 273/58 C |
| 3,637,209 | 1/1972 | Raut | 273/26 E |
| 3,934,473 | 1/1976 | Griffin | 273/58 C |
| 4,162,790 | 7/1979 | Kelsey | 273/26 E |
| 4,616,834 | 10/1986 | Davis | 273/58 C |

*Primary Examiner*—Theatrice Brown
*Attorney, Agent, or Firm*—Arthur G. Yeager

[57] ABSTRACT

A practice baseball and softball simulates fly balls to teach youngsters to catch fly balls. The ball has an elongated rope and a throughbore into which is placed a plastic sleeve with one end of the rope being clamped internally in the ball, and the other end of the rope extending outwardly from one end of the sleeve to be grasped by one who twirls the ball at the end of the rope around until it reaches sufficient speed to be released allowing the ball to sail through the air like a fly ball at various trajectories.

20 Claims, 1 Drawing Sheet

PRACTICE TETHERED BASEBALL

BACKGROUND OF THE INVENTION

The game of baseball is learned early by youngsters in school, "little leagues" and general playground activities. Here, the youngsters practice catching the ball, swinging the bat, and playing a position on an organized team. Of course, there is a need for frequent practice to develop the hand/eye coordination needed to catch a ball, hit a pitched ball, and throw a ball to a designated spot. In the practice of catching a ball, there are "line drives" and "fast throws" where the ball travels as close to a straight line as possible, never reaching an elevation of more than 6–7 feet above the ground; and there are "fly balls" where the ball reaches a high elevation before gravity makes the ball turn and fall to earth through a curve that is close to parabolic. In practice these balls are usually propelled by one tossing the ball in the air and hitting it as it falls to earth with a swinging baseball bat. The batter is sufficiently skilled to hit the ball high, like a "fly ball" or low, like a "line drive". For practice at home or whenever there is no skilled batter available, it is difficult to provide the necessary speed and trajectory to provide a good practice session. It is the purpose of this invention to provide a practice baseball and softball for use in place of a batter and/or for use by a single player in simulating "pop-ups".

It is an object of this invention to provide a baseball and a softball for use in the practice of catching the balls, particularly those hit as a fly ball. It is another object of this invention to provide a ball that can be thrown to simulate different types of batted balls. Still other objects can be found in the more detailed description of the invention which follows.

BRIEF SUMMARY OF THE INVENTION

This invention relates to a practice baseball or softball comprising a ball with a diametric first throughbore into which is a cylindrical clamping sleeve fitting snugly into said first throughbore, and having a lengthwise central axial second throughbore and two transverse bores located generally medially of said sleeve and spaced apart lengthwise of the sleeve. The sleeve includes an outwardly extending transverse flange at one end thereof, and a screw with a large diameter head screwed into the other sleeve end and seated in a counterbore in the first throughbore. A length of rope passes into the first throughbore through the one end of the sleeve and through the two transverse bores, and is clamped tightly between the first throughbore and the sleeve.

In specific and preferred embodiments of this invention the sleeve is a hollow tube of plastic material, the screw is a thread-cutting screw capable of cutting into the plastic sleeve and the flange head is partially recessed in the ball's outer surface. It is also preferred if the holes in the transverse bores are shaped such that one of each pair of holes is an oval, and that the two ovals are on opposite sides of the sleeve. Also, the end of the screw engages the rope within the sleeve after being threaded through the holes to provide a secure attachment of all components.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The features of this invention are best understood by reference to the attached drawings.

Figure 1:
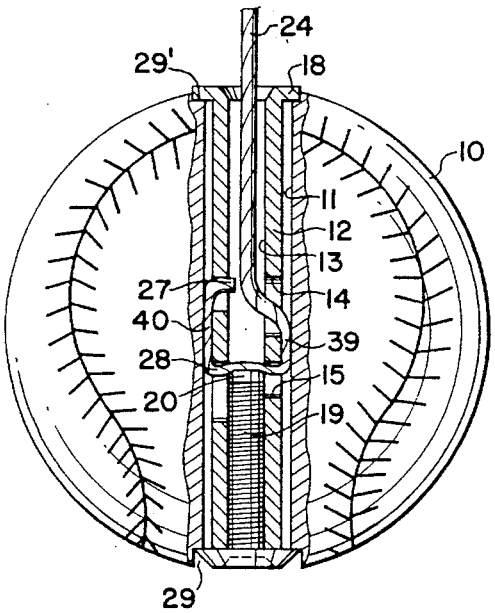
FIG. 1 is an elevational view, partly in cross-section, of the baseball or softball of this invention.

In FIG. 1 there is depicted a baseball 10 of this invention, , which may be a hard ball or a softball. Drilled along a diameter of ball 10 is a hole or throughbore 11 extending completely through ball 10 and of a size to admit the clamping sleeve 12 (shown in detail in FIGS. 2–4).

A length of rope 24, perhaps 12–18 inches long, is threaded into the central axial bore 13 of sleeve 12 and through two transverse bores 14 and 15. If the respective sizes of throughbore 11, sleeve 12, and rope 24 are appropriate rope 24 will be securely clamped to baseball 10. In addition, screw 19 has an unthreaded rounded tip pressed against rope 24 in transverse bore 15, further assuring the clamping of rope 24 in baseball 10. Head 23 of screw 19 is seated in a counterbore 29 in one end of throughbore 11 to prevent sleeve 12 from being pulled out of throughbore 11, and the head 23 is made to lie substantially flush with the outer surface of baseball 10.

Figure 4:
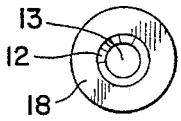
FIG. 4 is a top plan view of the clamping sleeve of FIGS. 2–3.
Figure 2:
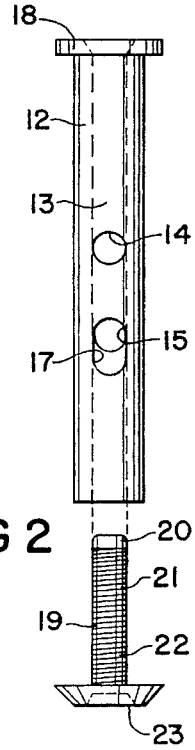
FIG. 2 is a front elevational exploded view of the clamping sleeve and clamping screw employed in the ball of this invention.
Figure 3:
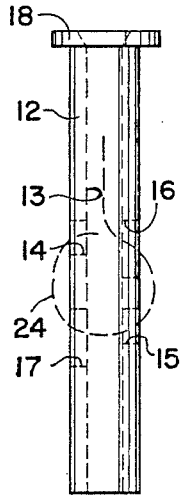
FIG. 3 is a side elevational view of FIG. 2, but omitting the clamping screw.

In FIGS. 2–4 there is shown the details of sleeve 12 wherein the sleeve 12 is a hollow cylindrical tube with a central throughbore 13, two transverse bores 14 and 15, and a transversely extending flange 18 at one end of sleeve 12. The other end of throughbore 13 is adapted to admit screw 19. Preferably sleeve 12 is plastic and screw 19 is a thread cutting screw. As an alternative, hollow 19 may have internal threads at its lower end and screw 19 may have standard threads to match those in hollow 13. Two features about screw 19 are important to the success of the invention. The forward tip 20 of screw 19 is not threaded, but is rounded at its circumferential edge, which permits it to press against rope 24 (see FIG. 1) to squeeze it and not to cut it. The other feature is that head 23 of screw 19 is sufficiently large in diameter to extend beyond the outside surface of sleeve 12 and to be seated in counterbore 29 (see FIG. 1) and be flush with the outside surface of the ball to deter injury to the players.

It is to be understood that reference to counterbore 29 may only be a pressured indentation to accommodate the thickness of the screw head 23 and likewise flange 18 may be partially or fully sunk into a similar counterbore 29', to provide an overall finish to the baseball 10.

Sleeve 12 also includes two transverse bores 14 and 15, which serve as guides for threading rope 24 in a manner such that it will be clamped inside baseball 10. As may be seen in FIG. 1, rope 24 is threaded from hollow 13 of sleeve 12 out one hole of transverse bore 14, back in one hole of transverse bore 15, out the other hole of transverse bore 15, and back in the second hole of transverse bore 14 to central to hollow 13. Because the outside diameter of sleeve 12 and the diameter of throughbore 11 are relatively close as compared to the diameter of rope 24, there are two locations 39 and 40 where rope 24 is jammed tightly between sleeve 12 and throughbore 11. In the manufacture of this practice ball, rope 24 is, of course, threaded into sleeve 12 and through the holes of transverse bores 14 and 15 before sleeve 12 threaded with rope 24 is pressed tightly into throughbore 11. The respective sizes of sleeve 12, throughbore 11, and rope 24 to provide the desired clamping action will depend on the compressibility of rope 24, and may require a few trial tests to determine the desired combination.

Transverse bores 14 and 15 result in four holes since each bore 14 and 15 passes through two walls due to the fact that sleeve 12 has an internal central axial hollow 13. Bores 14 and 15 are generally located somewhere in the middle of the length of sleeve 12, and are spaced apart lengthwise along sleeve 12. The shapes of the holes in bores 14 and 15 are not critical, and normally would be expected to be circular or oval. It has been found to be preferred to have one hole in each pair making up a transverse bore 14 and 15 to be oval and that the two oval holes to be on opposite sides of sleeve 12. This is shown in FIGS. 2–3 where oval hole 16 of bore 14 is on one side of sleeve 12 and oval hole 17 of bore 15 is on the opposite side of sleeve 12. The arrangement facilitates the threading of rope 24 initially from the internal throughbore 13, out oval hole 16 into hole 15, out oval hole 17 and into hole 14 to extend into throughbore 13.

Figure 5:
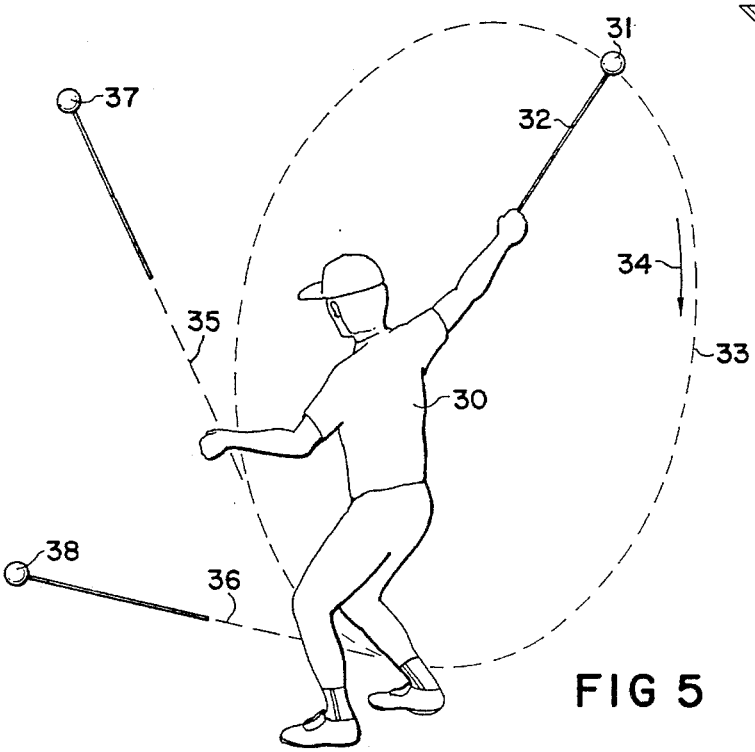
FIG. 5 is a schematic perspective view of a player using the practice ball of this invention.

FIG. 5 illustrates how the baseball of this invention is used. The player 30 wraps a portion of the free end of rope 32 around the first two fingers of his throwing hand and gripping same with thumb and swings the bail 31 forward about one fourth of an arc forward then back and forward again and continues around in a circle 34 in the direction of arrow 33 at arms length in a substantially vertical plane. If the centrifugal speed of the ball 31 reaches a suitable speed as judged by the player he releases his thumb grip on the rope 32, and ball 31, with rope 32 attached, speeds through the air for the practicing player (not shown) to catch. A release of ball 31 along line 35 produces a high "fly ball" 37 of player 30, or if he releases the .ball 31 a little earlier along line 36 a "line drive" is produced. Various types of simulations of batted balls can be produced by a skilled player 30, changing the centrifugal speed and the release point for the ball 31. Also, a "pop fly" can be obtained whereby the thrower player 30 can attempt to catch his own "pop fly".

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A tethered baseball comprising a baseball with a diametric first throughbore in which is positioned a cylindrical clamping sleeve fitting snugly into said first throughbore and having a lengthwise central axial second throughbore and two transverse bores located medially of the length of said sleeve and spaced apart lengthwise of said sleeve, said sleeve having an outwardly extending transverse flange at one end thereof, and a screw with a large diameter head screwed into the other end thereof while said head is seated in a counterbore in said first throughbore; and a length of rope extending from outside said baseball into said first throughbore through the end having said flange and through said two transverse bores, and being clamped tightly between said first throughbore and said sleeve.

2. The tethered baseball practice apparatus of claim 1 in which said first throughbore has a counterbore at each end thereof, one to seat said flange therein and the other to seat said head of said screw therein.

3. The tethered baseball practice apparatus of claim 2 wherein said head of said screw has a diameter larger than the outside diameter of said cylindrical sleeve.

4. The tethered baseball practice apparatus of claim 1 wherein said screw has no screw threads on the forward end of the screw shaft.

5. The tethered baseball practice apparatus of claim 4 wherein said screw has a shaft with the forward end thereof nonthreaded for a lengthwise distance of said shaft, and the remainder of said shaft being threaded to engage threads in said second throughbore.

6. The tethered baseball practice apparatus of claim 1 wherein said sleeve is made of a plastic material, and said screw has self-cutting screw threads thereon.

7. The tethered baseball practice apparatus of claim 1 wherein each of said spaced transverse bores comprises a pair of aligned holes through two opposite walls of s&id sleeve, one hole of each said pair being substantially circular and the other hole of each said pair being substantially oval; said two oval holes being on opposite sides of said sleeve.

8. The practice baseball of claim 1 wherein said baseball has an outer surface, said flange being recessed partially within said outer surface.

9. A tethered softball comprising a softball having a diametric throughbore filled with a plastic tubular sleeve having clamped therein one end of a length of rope with the other end of the rope extending outwardly of the softball through one end of the hollow of said tubular sleeve; the other end of said hollow being filled with the shank of a screw having external threads engaged with internal threads in said hollow, said screw having a head larger in diameter than the outside diameter of said sleeve, and seated in a counterbore in said softball; said sleeve at said one end having a flange extending transversely outwardly of said throughbore.

10. The tethered softball practice apparatus of claim 9 wherein said sleeve has two pairs of aligned passageways extending transversely through said sleeve through which said rope is threaded and clamped between said throughbore and said sleeve.

11. The tethered softball practice apparatus of claim 9 wherein said screw has a forward end without external threads and adapted to clamp said rope between said screw and said sleeve.

12. A tethered baseball comprising a baseball having an outer surface with a diametric first throughbore having an inner surface, an elongated cylindrical clamping sleeve having opposite end portions and fitting snugly into said first throughbore and having a lengthwise central axial second throughbore and two spaced transverse bores located generally medially of said end portions of said sleeve, said sleeve having an outer surface and an outwardly extending transverse flange at one said end portion engaged with said outer surface of said baseball, a screw with a large diameter head screwed into said other end portion of said sleeve, said head being seated in a counterbore in said outer surface aligned with said first throughbore, and an elongated rope having opposite end portions, said one end portion of said rope extending from outside said baseball into said second throughbore through said one end portion thereof and through said two transverse bores, and being clamped tightly between said first throughbore inner surface and said sleeve outer surface.

13. The tethered baseball practice apparatus of claim 12 in which said first throughbore has a counterbore at each end thereof, one to seat said flange therein and the other to seat said head of said screw therein, said head of said screw has a diameter larger than the outside diameter of said cylindrical sleeve.

14. The tethered baseball practice apparatus of claim 12 wherein said screw includes a shaft with a forward end portion thereof nonthreaded, and the remainder of said shaft being threaded to engage threads in said second throughbore of said sleeve.

15. The tethered baseball practice apparatus of claim 12 wherein said sleeve is a plastic material, and said screw has self-cutting screw threads thereon.

16. The tethered baseball practice apparatus of claim 12 wherein each of said spaced transverse bores comprises a pair of aligned holes through two opposing sides of said sleeve, one hole of each said pair being substantially circular and the other hole of each said pair being substantially oval, said two oval holes being on opposite sides of said sleeve.

17. The tethered baseball practice apparatus of claim 16 wherein said one end portion extends through one said oval hole from said second throughbore into one said circular hole through the other said oval hole and into the other said circular hole to dispose two portions of said rope on opposite sides of said sleeve and being clamped by said inner surface of said first throughbore as said sleeve is positioned into said first throughbore.

18. The tethered baseball practice apparatus of claim 16 wherein said screw includes an inner end portion which is smooth and nonthreaded to engage against said rope and squeeze same against an inner surface of said second throughbore.

19. The tethered baseball practice apparatus of claim 12 wherein said head of said screw is substantially flush with said outer surface of said baseball.

20. The tethered baseball practice apparatus of claim 19 wherein said screw head is pressed into said outer surface of said baseball by screwing same into said sleeve.

* * * * *